US011771268B1

(12) United States Patent
House

(10) Patent No.: US 11,771,268 B1
(45) Date of Patent: Oct. 3, 2023

(54) ROLLING MEDICAL BEDSIDE BATHING TUB

(71) Applicant: Dale House, Murrieta, CA (US)

(72) Inventor: Dale House, Murrieta, CA (US)

( * ) Notice: Subject to any disclaimer, the term of this patent is extended or adjusted under 35 U.S.C. 154(b) by 109 days.

(21) Appl. No.: 17/334,643

(22) Filed: May 28, 2021

Related U.S. Application Data

(60) Provisional application No. 63/034,244, filed on Jun. 3, 2020.

(51) Int. Cl.
*A47K 3/062* (2006.01)
*A61G 7/00* (2006.01)

(52) U.S. Cl.
CPC ..... *A47K 3/062* (2013.01); *A61G 7/0005* (2013.01); *A61G 2200/34* (2013.01)

(58) Field of Classification Search
CPC .... A61G 7/005; A61G 7/1003; A61G 7/0503; A61G 1/044; A47K 3/022; A47K 3/003; A47K 3/06; A47K 3/064; A47K 3/12; A47K 3/074; A47K 3/122; A47K 3/125; A47K 3/127; A47K 3/16–17; A47C 7/40; A47C 7/44; A47C 7/462; E04H 4/14
See application file for complete search history.

(56) References Cited

U.S. PATENT DOCUMENTS 351,103 A 10/1886 French
2,420,448 A 5/1947 Siers
3,469,266 A 9/1969 Hyde
3,755,830 A 9/1973 Johns
3,803,642 A 4/1974 Erling et al.
4,074,370 A * 2/1978 Harmony, III ..... A61G 7/0005 4/575.1
4,432,104 A * 2/1984 Sasaki ..... A61G 7/1003 4/560.1
4,485,502 A 12/1984 Marcanio
4,553,276 A 11/1985 Paradis
4,785,486 A 11/1988 Viesturs
5,022,102 A 6/1991 Louvaris
5,025,515 A 6/1991 Rhines
5,247,712 A 9/1993 Williams
5,343,575 A 9/1994 Cartwright
5,909,970 A 6/1999 Velázquez
(Continued)

FOREIGN PATENT DOCUMENTS

CN 110150890 * 8/2019 ..... A47C 7/462
DE 19938653 * 8/2000 ..... A47K 3/125
(Continued)

*Primary Examiner* — David P Angwin
*Assistant Examiner* — Nicholas A Ros
(74) *Attorney, Agent, or Firm* — John Rizvi; John Rizvi, P.A.—The Patent Professore®

(57) ABSTRACT

A rolling medical bedside bathing tub is designed and configured to facilitate bathing for bedridden and other people with limited mobility. The bathing tub includes a bottom wall forming the bottom side of the bathing tub and a plurality of sidewalls extending from the bottom walls to define an enclosure. The bathing tub may include a backrest and an extendable seat to assist people in maintaining balance within the tub. Preferably, the bathing tub is portable. Additionally, the bathing tub may be extendable to allow for people of varying heights and sizes. A method for using the bathing tub is also provided.

18 Claims, 7 Drawing Sheets

(56) References Cited

U.S. PATENT DOCUMENTS

| | | | | | |
|---|---|---|---|---|---|
| 6,088,847 | A * | 7/2000 | Burrow | A47K 3/122 | 4/578.1 |
| 6,088,848 | A | 7/2000 | Waterlyn | | |
| 6,381,769 | B1 | 5/2002 | Lofquist, Jr. | | |
| 6,802,088 | B1 * | 10/2004 | Gruner | A61G 7/0005 | 4/575.1 |
| 7,140,054 | B2 * | 11/2006 | Charles | A61G 7/0509 | 4/585 |
| 9,066,632 | B2 | 6/2015 | Millerd | | |
| 9,125,777 | B2 * | 9/2015 | Patrick | A61G 7/1028 | |
| 9,427,116 | B2 | 8/2016 | Frederick | | |
| 9,622,622 | B2 | 4/2017 | Sundberg et al. | | |
| D827,793 | S | 9/2018 | Derrickson | | |
| 2004/0078887 | A1 | 4/2004 | Kuntz | | |
| 2005/0005350 | A1 | 1/2005 | Johnson et al. | | |
| 2006/0265803 | A1 * | 11/2006 | Brunelle | A61H 33/0087 | 4/541.1 |
| 2007/0107120 | A1 | 5/2007 | Ingraham | | |
| 2010/0175702 | A1 * | 7/2010 | West | A61G 1/044 | 128/876 |
| 2010/0212084 | A1 | 8/2010 | Gibson | | |
| 2012/0286010 | A1 * | 11/2012 | Mann | G09F 23/00 | 224/407 |
| 2015/0067959 | A1 | 3/2015 | Kapp et al. | | |
| 2015/0313415 | A1 | 11/2015 | Pearce | | |
| 2019/0082896 | A1 | 3/2019 | Ramirez et al. | | |

FOREIGN PATENT DOCUMENTS

| | | | | |
|---|---|---|---|---|
| KR | 20050043822 | * 5/2005 | A47K 3/06 | |
| KR | 20190002034 | 8/2019 | | |
| WO | 2001072191 | 10/2001 | | |
| WO | WI2012131535 | * 10/2012 | A47K 3/06 | |

* cited by examiner

ROLLING MEDICAL BEDSIDE BATHING TUB

CROSS-REFERENCE TO RELATED APPLICATIONS

This application claims the benefit of U.S. Provisional Patent Application No. 63/034,244, filed on Jun. 3, 2020, which is incorporated by reference herein in its entirety.

FIELD OF THE INVENTION

The present invention relates generally to a foldable and portable bathing tub. More particularly, the present invention relates to a foldable and portable bathing tub adaptable for use in hospitals, rehabilitation centers, assisted living facilities, and residential homes for the washing and bathing of elderly, disabled, partially disabled, bedridden, or generally immovable patients. Additionally, the tub may be extendable so as to better accommodate patients of varying heights.

BACKGROUND OF THE INVENTION

Assistive technology is often needed when assisting bedridden and other persons with reduced mobility. Senility, obesity, accidents (traffic, work, home, sports, etc.), strokes, and spinal injuries are the main causes for being bedridden. Of these, senility is by far the major cause. The number/ratio of seniors increases as the quality of life and average life expectancy increase. Eighty million people in the U.S. will be 65 or older within a few decades, compared with around 50 million today, and, according to surveys conducted by AARP Inc., the desire to grow old at home is almost universal. Most who do so will need help with daily tasks and will exhaust the ability of family and friends to cook and clean, run errands, and arguably most importantly, bathe.

Bathing is a very important part of life and it is especially important for the dignity of the individual that, where possible, this can be done privately without the need for assistance. Even in situations where assistance is required and offered, there is great difficulty in providing that assistance to enable the bather to enter a bathtub for bathing due to the structure of a bathtub which requires the caregiver to lean over the front wall of the bathtub while assisting the weight of the bather entering the bathtub.

Entering ordinary bathtubs often requires stepping over the side of the tub. Even if the bathtub is sunken or even flush with the floor, balance and strength is required to step down into the tub without falling. The same is true if steps are provided to assist one in getting up and over the side of a bathtub.

Even when persons with limited mobility are able to get inside the bathtub, they often find it difficult to use ordinary bathtubs. An ordinary bathtub has little that aids people with limited mobility in balancing themselves while standing or sitting in the tub. If such people have difficulty standing or sitting upright unassisted, they may fall while attempting to use the tub. Falling may occur while attempting to stand upright in the tub or while lowering themselves in order to sit in the tub.

From both of these points of view, therefore, there is a very great need for bathing apparatus which is designed particularly for bedridden or generally immovable persons. Furthermore, a bedridden person cannot perform the crucial activities of daily living like eating, bathing, toileting, dressing, etc. These persons are dependent on caregivers due to reduced mobility. One of the most laborious tasks for nurses and caregivers is moving the patient into/out of bed (transferring and handling, where transferring means moving a patient from one surface keeping him/her horizontal to another same height surface and handling means a more complex movement for instance from chair to bed) for toileting, showering, etc. This transference usually occurs from the bed to a stretcher/wheelchair or vice versa. Besides being laborious, there is also a risk of injury, not only to the patient but also to the caregiver due to the need for physical force.

Accordingly, there remains a need in the art for a solution to at least one of the aforementioned problems. For instance, a bathtub that can assist in balancing an individual with limited mobility is desired. Additionally, a bathtub that can assist caregivers in bathing generally immobile individuals without having to transport those individuals to a bathroom is also desired. Lastly, it would be preferable if the bathtub could accommodate people of a wide variety of heights and sizes.

SUMMARY OF THE INVENTION

The present invention is directed to a rolling medical bedside bathing tub that facilitates bathing for bedridden and other people with limited mobility. The bathing tub includes a bottom wall forming the bottom side of the bathing tub and a plurality of sidewalls extending from the bottom walls to define an enclosure. The bathing tub may include a backrest and an extendable seat to assist people in maintaining balance within the tub. Preferably, the bathing tub is portable. Additionally, the bathing tub may be extendable to allow for people of varying heights and sizes. A method for using the bathing tub is also provided.

The rolling medical bedside bathing tub may solve a number of challenges currently associated with bathing bedridden and other people with limited mobility. Firstly, the tub is portable and includes a drainage port, making it much easier for caregivers to transport patients to the tub. Secondly, the tub includes a seat and a backrest, along with straps and other mechanisms that aid in balancing a patient while in the tub, making the process of bathing easier and more efficient. Lastly, the tub is designed to accommodate people of varying heights and sizes, allowing for the tub to be able to be universally used for people with limited mobility.

In a first implementation of the invention, a rolling medical bedside bathing tub comprises:

a bottom wall forming a bottom side of the bathing tub, the bottom wall having a plurality of edges;

a plurality of sidewalls, the plurality of sidewalls extending from the plurality of edges of the bottom wall defining an enclosure and including a plurality of side skirts;

a slidable seat included on the bottom wall of the bathing tub; and a plurality of casters attached to the plurality of side skirts.

In a second aspect, the bottom wall may be comprised of a rigid, sturdy, and nonabsorbent material.

In another aspect, the bottom wall may include one or more straps designed and configured to a hold a person's legs in place.

In another aspect, the bottom wall may include a drain.

In another aspect, the drain may be connected to a drainage basin, wherein the drainage basin includes a drain port.

In another aspect, drain port may be sized and configured to attach to a tubing and to release a water from the bathing tub.

In another aspect, the seat may be affixed to a slidable rail such that the position of the seat within the tub is adjustable.

In another aspect, the seat may be slidable about the rail at an indeterminate distance along the length of the bottom wall.

In another aspect, the rolling medical bedside bathing tub may include a backrest.

In another aspect, the backrest may include a harness.

In another aspect, the backrest may include a plurality of support struts adapted to releasably position the backrest in at least one inclined position above a horizontal level.

In another aspect, the backrest may include a bracket designed to mate with the plurality of supports to enable the backrest to maintain at least one inclined position above a horizontal level.

In another aspect, the plurality of sidewalls may include an insert designed to extend the sidewalls.

In another aspect, the plurality of sidewalls may include a tray designed to hold a person's medical records.

In another aspect, the plurality of casters may include one or more vertical attachment members designed to attach the caster to the bottom side of the bottom wall of the bathing tub.

In another aspect, the plurality of casters may include one or more horizontal support members designed to add rigidity to the casters.

In another aspect, the one or more support members may include a container designed and configured to hold medical equipment.

In another implementation of the invention, a method of operating the rolling medical bedside bathing tub comprises:

obtaining a rolling medical bedside bathing tub, the tub having a bottom wall forming a bottom side of the bathing tub, the bottom wall having a plurality of edges, a plurality of sidewalls, the plurality of sidewalls extending from the plurality of edges of the bottom wall defining an enclosure, and a plurality of casters attached to the bottom wall;

procuring a water source;

placing a user inside the tub;

seating the user on a slidable seat within the tub;

adjusting the seat position such that the user's whole body may lay in the tub;

positioning the user's back to lie against a backrest within the tub;

strapping the arms of the user within a harness on the backrest;

adjusting the position of the backrest as desired by the user;

strapping the user's legs with at least one strap on the bottom wall of the tub;

having another person bathe the user using the water source;

draining the water from the tub through a drain and out a drainage port;

having the user exit the tub; and folding the medical bedside bathing to a storage position and rolling the tub away upon draining the water from the tub and completion of use.

In another aspect, an additional insert may be placed within the sidewalls of the tub to extend the tub.

In another aspect, a medical container may be placed on a horizontal support member of the tub, the medical container being designed to carry necessary medical equipment for the user.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a rolling medical bedside bathing tub that is designed and configured to aid in the bathing of bedridden and generally immovable people. The bathing tub may include a bottom wall forming a bottom side of the bathing tub, the bottom wall having a plurality of edges and a plurality of sidewalls, the plurality of sidewalls extending from the plurality of edges of the bottom wall defining an enclosure. The medical bedside bathing tub further includes a drain and drainage port to release all water from the tub after use. Additionally, the medical bedside bathing tub may include a plurality of casters that allow for the tub to be easily portable. The medical bedside bathing tub may also include a number of accessories such as, but not limited to, additional inserts and medical containers to facilitate easier and more efficient use for a variety of patients.

Figure 1:
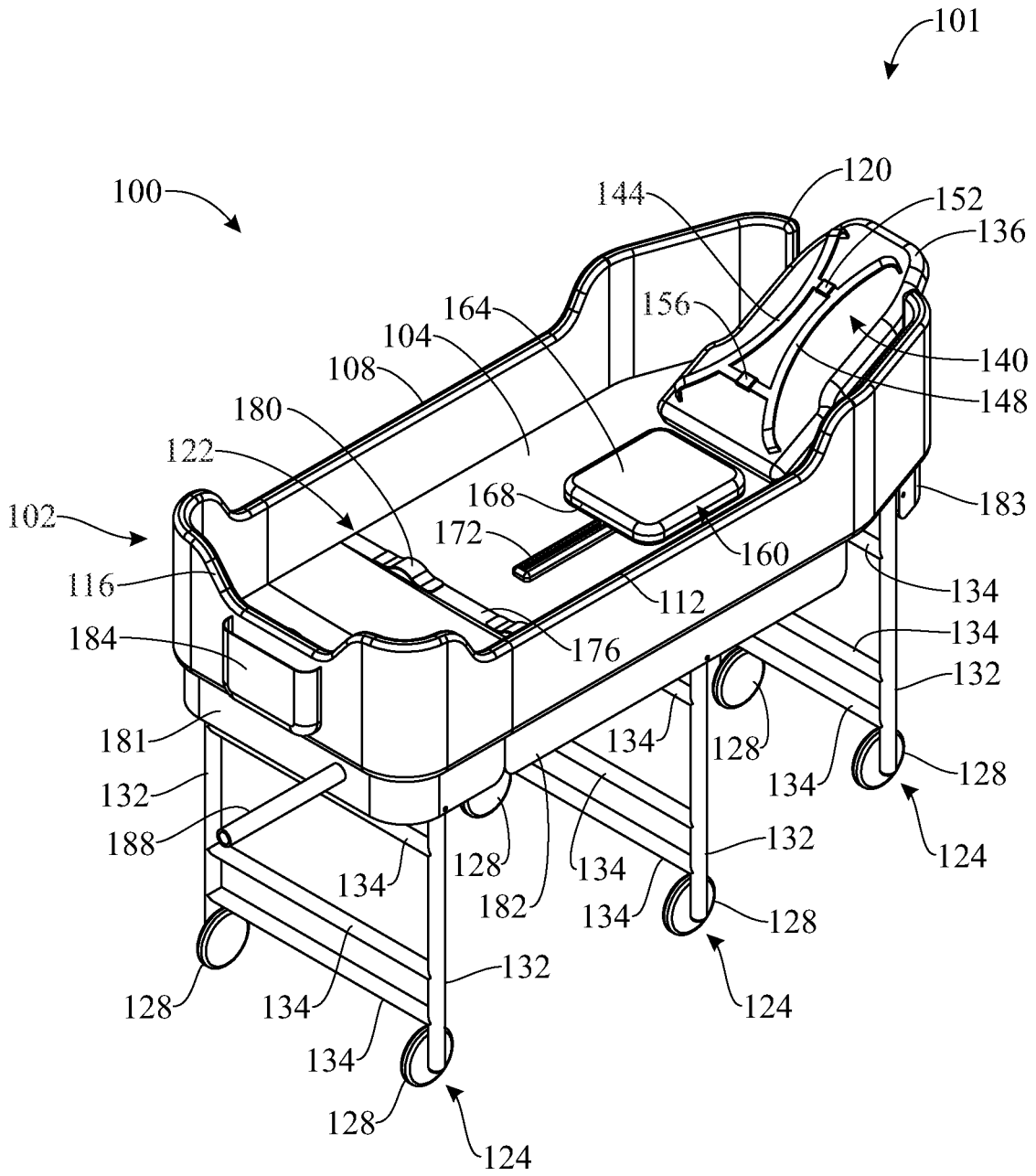
FIG. 1 presents a top front isometric view of a rolling medical bedside bathing tub in accordance with a first illustrative embodiment of the invention.
Figure 2:
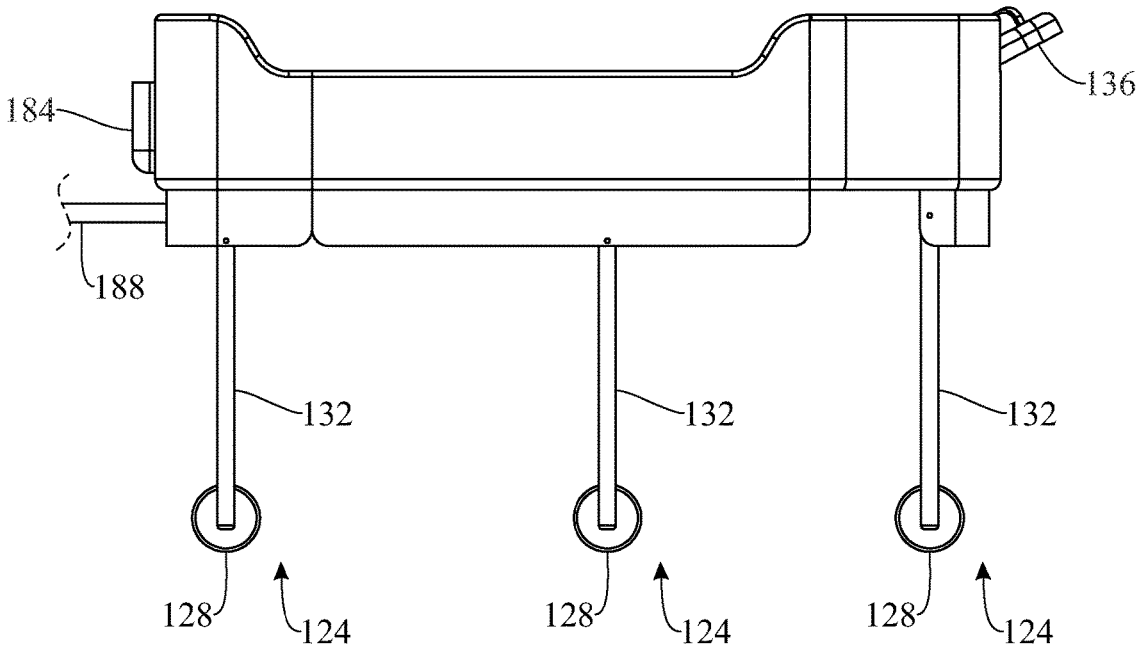
FIG. 2 presents a side elevation view of the rolling medical bedside bathing tub illustrated in FIG. 1.

Referring initially to FIG. 1, a medical bedside bathing tub 100 is illustrated in accordance with an exemplary embodiment of the present invention. As shown, the tub 100 has a rear or proximal end 101 and a front or distal end 102. The bathing tub 100 further includes a bottom wall 104 forming a bottom side of the bathing tub 100, as well as a plurality of sidewalls 112, 116, 120, 124 which extend from a plurality of edges of the bottom wall 104 to define an enclosure having an interior space 122. The bathing tub 100 also includes a plurality of casters 124 attached to a plurality of side skirts 181, 182, 183 which extend from the plurality of sidewalls 112, 116, 120, 124, as best shown in FIG. 2. The exterior portions of the sidewall 116 may also include additional accessories such as a pocket 184. The bathing tub 100 may be adjustable so as to allow users of varying lengths and sizes as described in detail hereinafter.

Figure 5:
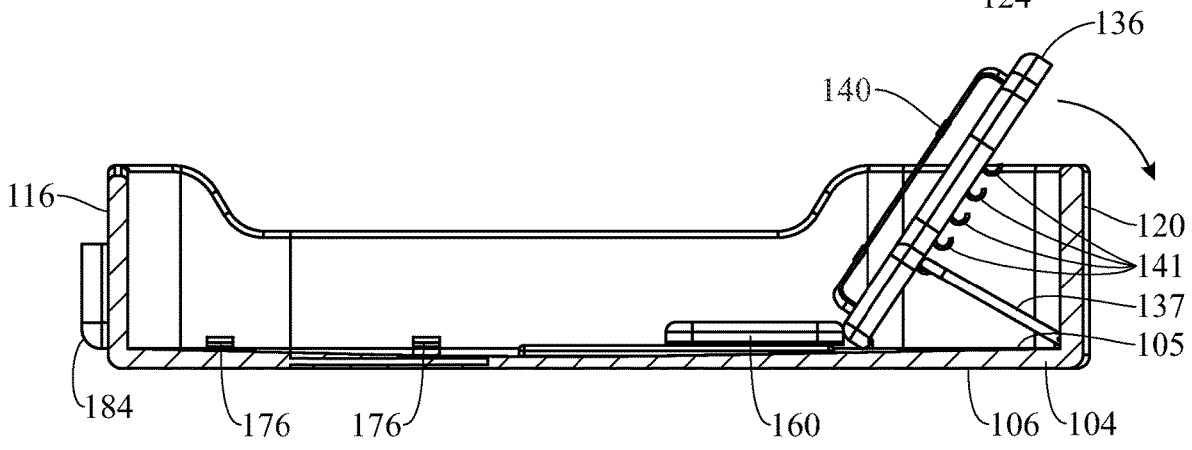
FIG. 5 presents a presents a cross-sectional, side elevation view of the rolling medical bedside bathing tub illustrated in FIG. 1.

As best shown in FIG. 5, the bottom wall 104 includes a top surface 105 and an underside or bottom surface 106. Extending from the edges of the bottom wall 104 are the aforementioned plurality of sidewalls 112, 116, 120, 124, as shown in FIG. 1. The plurality of sidewalls surrounds the edges of the bottom wall 104 defining the interior space 122 with the top surface 105 of the bottom wall 104. Within the interior space 122, as will be described in greater detail hereinafter, are a number of components that aid in the functionality and use of the tub 100. Preferably, the bottom wall 104 is comprised of a rigid, sturdy, and nonabsorbent material. The bottom wall 104 may be greater in length than in width. The sidewalls 112, 116, 120, 124 are proportional in length to the respective side of the bottom wall 104 from which they extend. Thus, the sidewalls 116, 120 on the ends are shorter in length than the sidewalls 108, 112 on the sides, which run the length of the bottom wall 104. Additionally, as will be mentioned in greater detail hereinafter, the height of the sidewalls 116, 120 on the ends may be shorter than the height of the sidewalls 108, 112 on the sides 108, 112.

Figure 6:
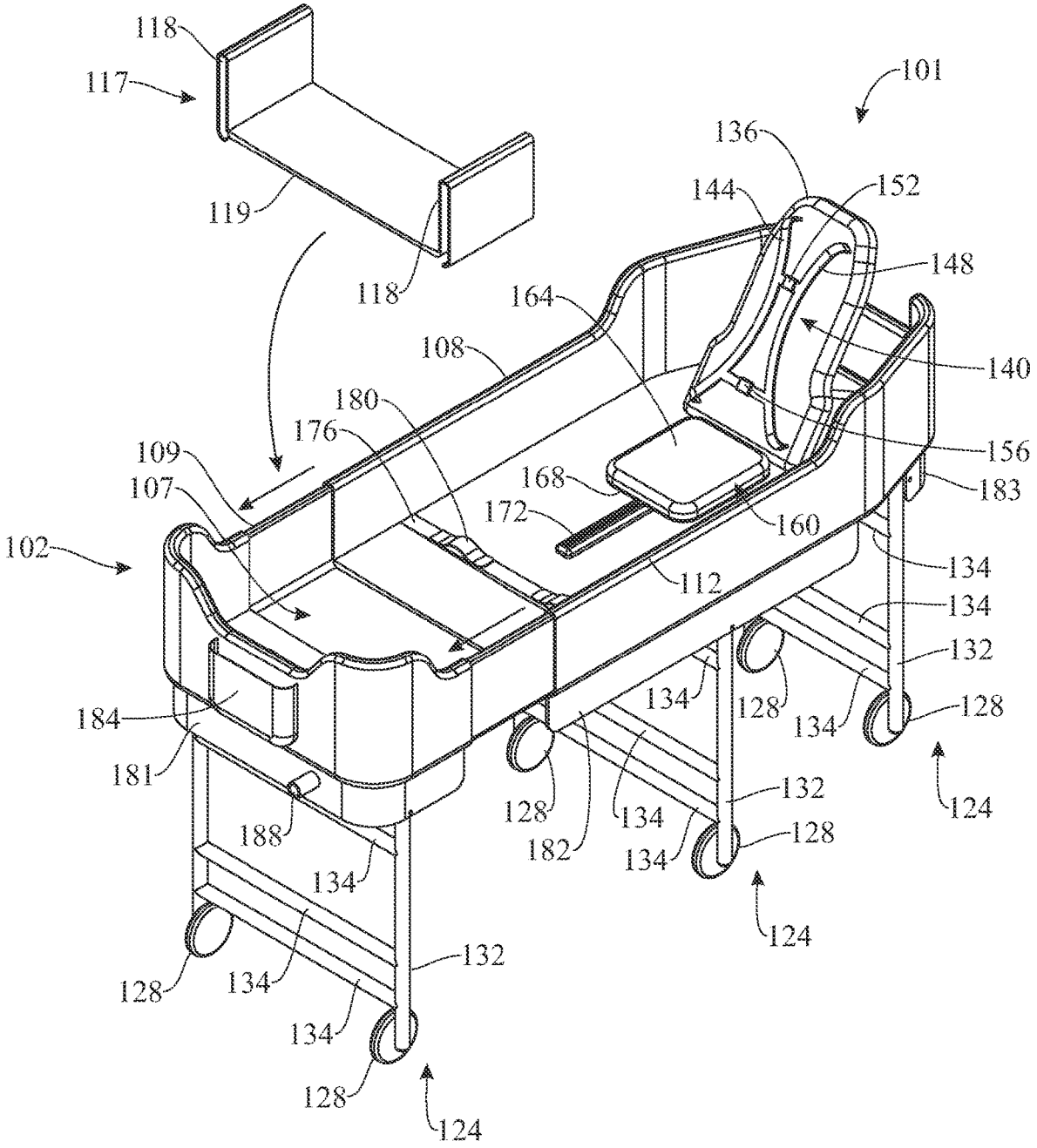
FIG. 6 presents a top front isometric view of the rolling medical bedside bathing tub illustrated in FIG. 1, with an additional insert that may be used to lengthen the tub.
Figure 7:
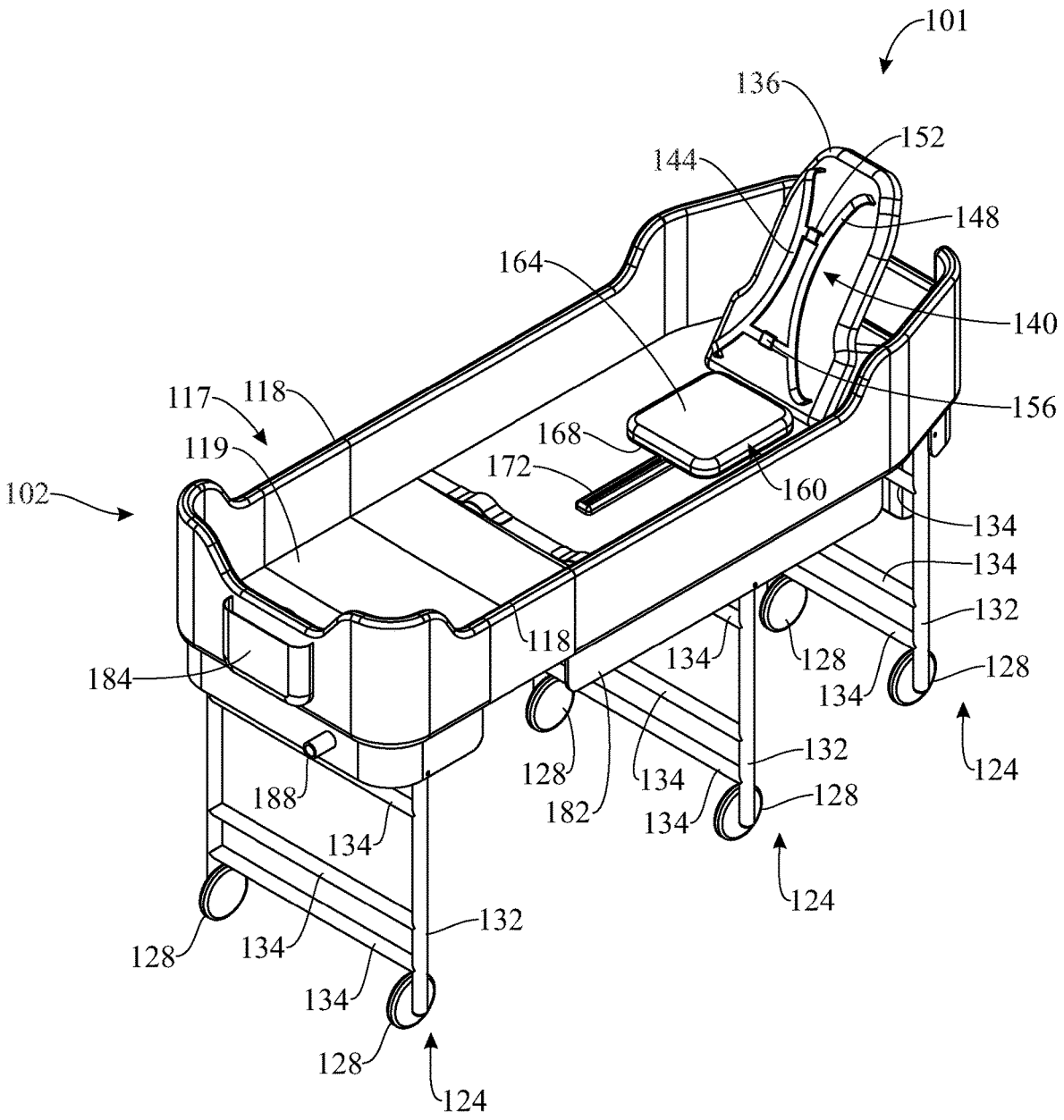
FIG. 7 presents a top front isometric view the rolling medical bedside bathing tub illustrated in FIG. 6, with the additional insert inserted into the tub, lengthening the tub.

Referring now to FIG. 6, the sidewalls 108, 112 may be extendable upon pulling on the sidewalls 108, 112 at the distal end 102 of the bathing tub 100. The bathing tub 100 includes a plurality of movable sidewall portions 109, 113 that may be housed within the sidewalls 108, 112. The movable sidewall portions 109, 113 may be extend the length of sidewalls 108, 112. Upon extension, the movable sidewall portions 109, 113 define an opening 107 from the edge of the bottom wall 104 to an intermediate distance at the distal end 102 of the bathing tub 100. The bathing tub 100 further includes an insert 117 configured to be fitted over the opening 107 and the movable sidewall portions 109, 113. The insert 117 may include two vertical members 118 designed to fit over the movable sidewall portions 109, 113 of the sidewalls 108, 112. The vertical members 118 may be connected to each other by a horizontal member 119, which once inserted, serves as an extension of the bottom wall 104 such that the opening 107 is filled and the insert 117 is flush with the bottom wall 104, as shown in FIG. 7.

Figure 3:
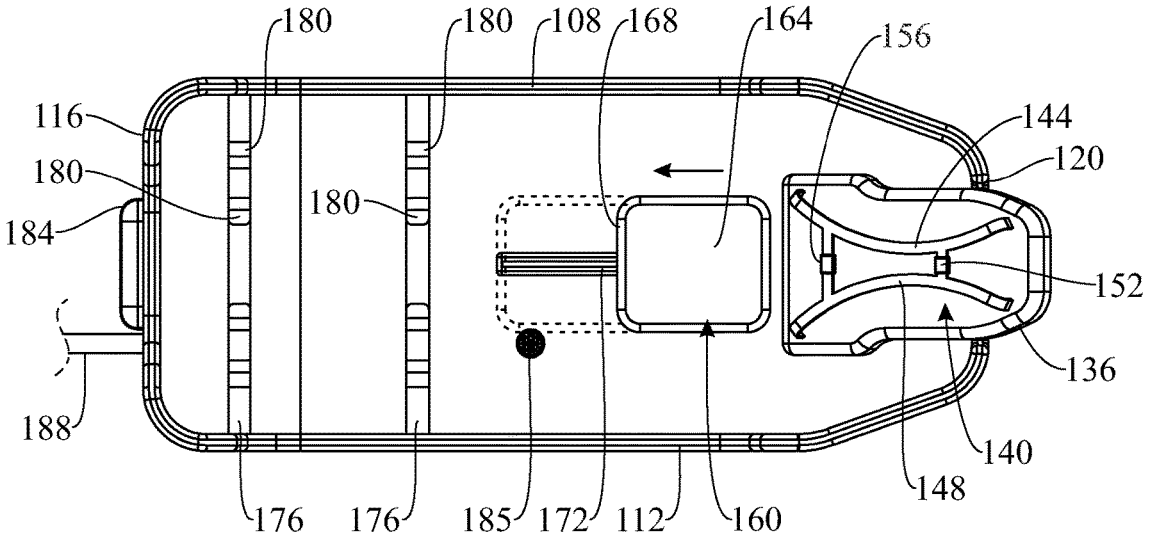
FIG. 3 presents a top plan view of the rolling medical bedside bathing tub illustrated in FIG. 1.
Figure 4:
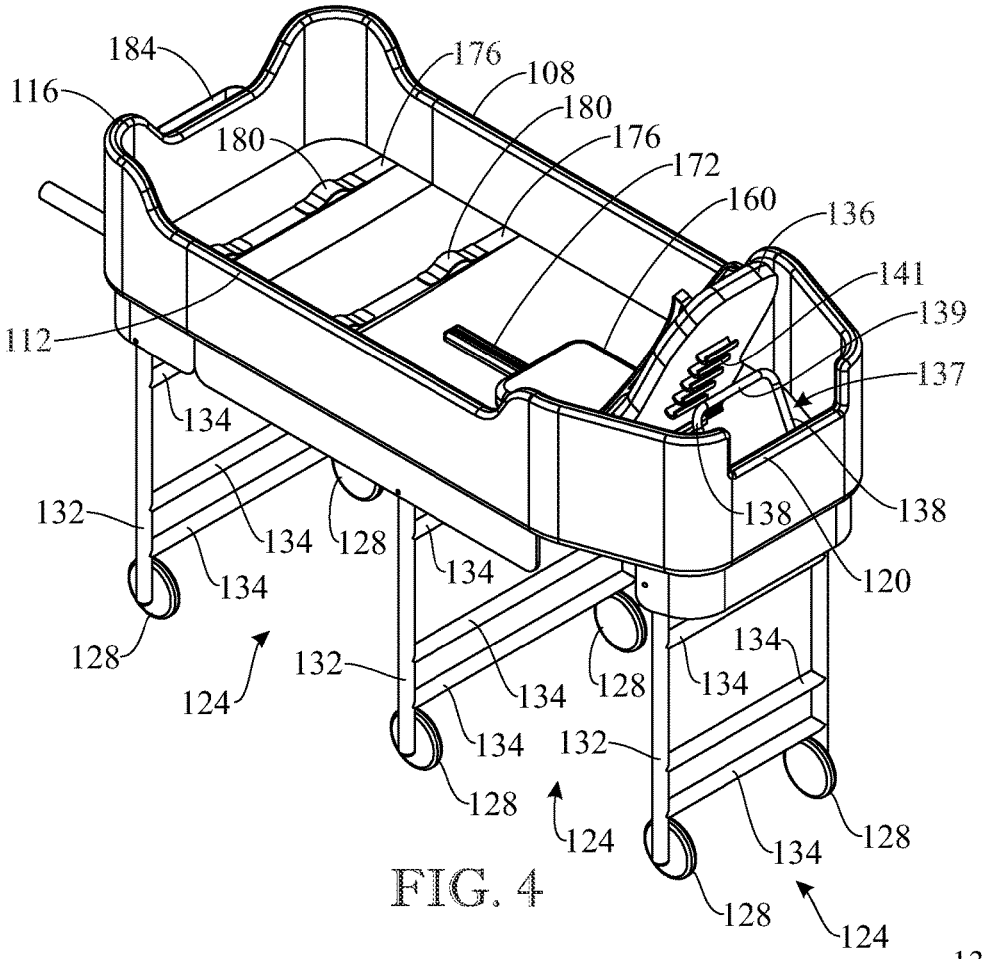
FIG. 4 presents a presents a top back isometric view of the rolling medical bedside bathing tub illustrated in FIG. 1.

Referring back to FIG. 1, at the proximal end 101 of the bathing tub 100 lies a backrest 136. The backrest 136 may be attached to the top surface 105 of the bottom wall 105 by a bracket 137, as shown in FIG. 5. The bracket 137 may include two vertical members 138 attached to each other by a horizontal member 139, as shown in FIG. 4. The bracket 137 may form an acute angle with the top surface 105 of the bottom wall 104 and may connect to a plurality of support struts 141 on a back side of backrest 136, as shown in FIGS. 4 and 5. The angle by which the backrest 136 sits with respect to the top surface 105 of the bottom wall 104 of the bathing tub 100 may be adjusted by attaching the bracket 137 to a different one of the plurality of support struts 141. With reference to FIG. 2, the bracket 137 may not engage at all with the backrest 136, allowing part of the backrest 136 to lie against the proximal end 101 sidewall 120 and allowing a top portion of the backrest 136 to lie outside the interior space 122 of the bathing tub 100. As best shown in FIGS. 1 and 3, the front side 139 of the backrest 136 may include a harness 140. The harness 140 may include two concave-shaped support straps 144, 148 whose curved portions face each other. At two intermediate distances between each of the support straps 144, 148 lie a first buckle 152 and a second buckle 156 which connect each of the support straps 144, 148 to each other. For reasons that will be mentioned hereinafter, the second buckle 156 lies beneath the first buckle 152 and is preferably greater in length than the first buckle 152. The buckle 152 may be of a variety of types, for instance, but not limited to, a side-release buckle or a conventional belt buckle. The backrest 136 may be greater in width at the bottom of the backrest 136 than at the top of the backrest 136.

With continued reference to FIGS. 1 and 3, adjacent to the backrest 136, at an intermediate distance from the proximal end 101 of the bathing tub 100 is a slidable seat 160. The slidable seat 160 includes a top surface 164 and at least one side surface 168. The slidable seat 160 may be a variety of shapes, for instance, squared or alternatively, circular. The top surface 164 of the slidable seat 160 is designed to accommodate a single person. The slidable seat 160 may rest on a rail 172 which sits on the top surface 105 of the bottom wall 104, allowing the position of the seat 160 with respect to its placement along the top surface 105 of the bottom wall 104 to be adjustable for the entire length of the rail 172.

With continued reference to FIG. 3, along the top surface 105 of the bottom wall 104 at some intermediate distance away from the seat 160 towards the distal end 102 of the bathing tub 100 lies at least one strap 176 which runs the width of the bottom wall 104 from sidewall 108 to sidewall 112. The strap 176 may include a plurality of buckles 180 designed to tighten and loosen the strap 176 as needed. The top surface 105 of the bottom wall 104 may include additional straps 176.

Figure 10:
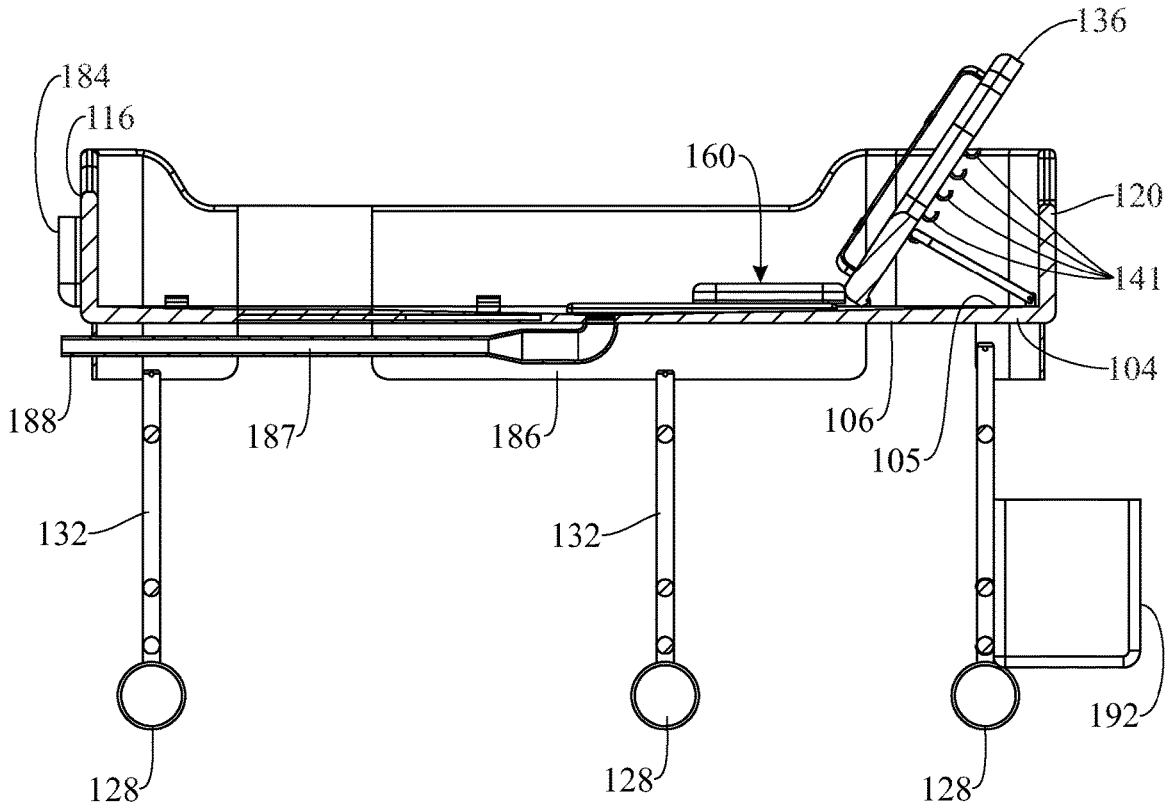
FIG. 10 presents a presents a cross-sectional side elevation view of the rolling medical bedside bathing tub illustrated in FIG. 8, including a drainage basin and drainage port.

As best shown in the FIG. 3, the bottom wall 104 of the bathing tub 100 includes a drain 185. The drain 185 may a variety of shapes, for instance, circular and is designed to release any water from within the tub 100. The drain 185 leads to a drainage basin 186 which may be connected to the bottom or underneath surface 106 of the bottom wall 104, as shown in FIG. 10. The drainage basin 186 is designed to hold an appreciable amount of water such that the tub 100 can be efficiently drained. The drainage basin 186 may be connected to a channel 187 that runs from the drainage basin 186 to the remaining length of the bathing tub 100 and exits through a drainage port 188 at the distal end 102 of the bathing tub 100. The drainage port 188 may be configured to be attached to a tubing to further extend the area by which the water in the bathing tub 100 is to be drained. For instance, if the water is to be drained in another room as the tub. The channel 187 may be narrower in diameter than the drainage basin 186. Both the drainage basin 186 and the channel 187 are preferably made from nonabsorbent, sturdy materials that facilitate adequate fluid flow. Additionally, the drainage basin 186 is hidden behind the plurality of side skirts 181, 182, 183 which extend from the sidewalls 116, 120, 112 and run at least some intermediate portion around the bathing tub 100, as best shown in FIG. 10.

Figure 8:
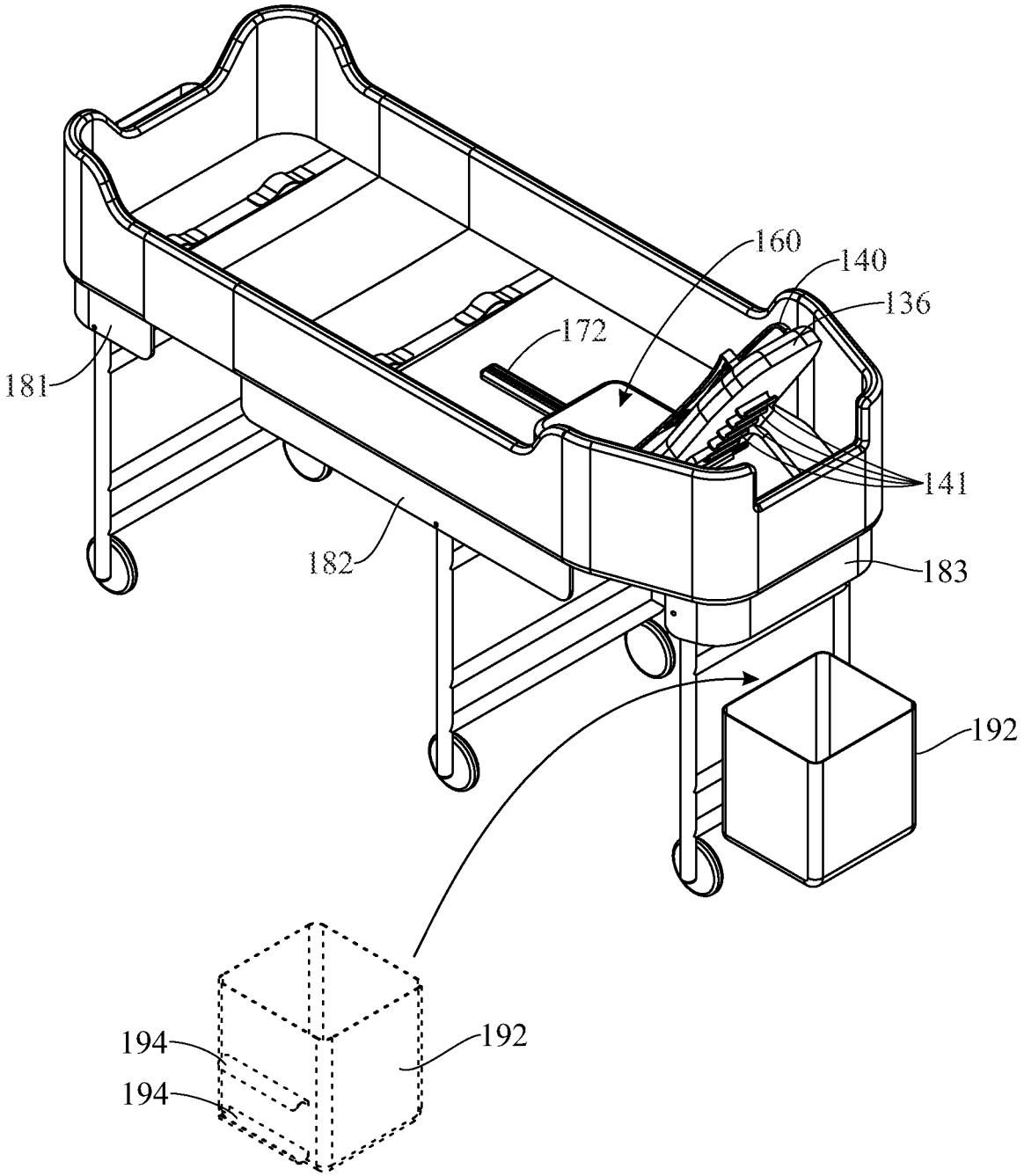
FIG. 8 presents a top rear isometric view of the rolling medical bedside bathing tub illustrated in FIG. 7, with an additional medical container mounted to a horizontal support member of the tub.

Referring now to FIG. 2, attached to each of the plurality of side skirts 181, 182, 183 are a pair of casters 124. The casters 124 include a pair of wheels 124 each attached to a pair of vertical support members 132 that extend from each of the plurality of side skirts 181, 182, 183. Each vertical support member 132 of each individual caster 124 may be spaced the width of the bottom wall 104. Each caster 124 is spaced some intermediate distance from each other, spanning the length of the bottom wall 104 from the proximal end 101 to the distal end 102 of the bathing tub 100. Additionally, the casters 124 may include a plurality of horizontal support members 134 that connect the pair of vertical members 132 of each caster 124, as shown in FIG. 4. The horizontal support members 134 may function as grooves to support additional accessories, such as a medical container 192, as shown in FIG. 8. The medical container 192, or other accessory, may attach to the horizontal members 134 via brackets 194 on the container 192. The container 192 may be used to house necessary medical components for a user, such as a respirator or a vitals monitor. For reasons that will be described in greater detail hereinafter, the casters 124 are preferably foldable such that the bathing tub 100 can be put in a portable or storage position. The casters 124 may be foldable in a manner that allow the bathing tub 100 to be rolled while in the portable or storage position, as shown in FIG. 9.

Figure 9:
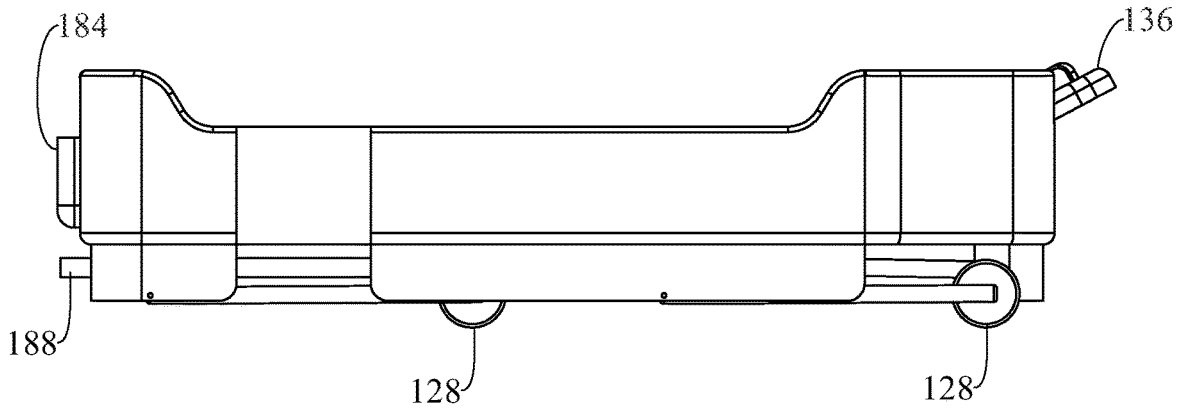
FIG. 9 presents a side elevation view of the rolling medical bedside bathing tub illustrated in FIG. 8, with the rolling medical bedside bathing tub folded into a portable and storage position.

The illustration of FIGS. 6-9 best demonstrates a method of operation of the medical bedside bathing tub 100. Referring initially to FIG. 9, the bathing tub 100 is rolled in to the room of a bedridden or generally immovable patient by a caregiver. The bathing tub 100 at this point is in a portable position with the casters 124 folded up, however because some of the wheels 128 are still exposed to the ground, the bathing tub 100 may still be rolled. Upon rolling the bathing tub 100 in to the desired room, the caregiver unfolds the casters 124 such that the vertical support members 132 are perpendicular to ground and all wheels 128 sit on the ground.

Once the bathing tub 100 is unfolded in to a use position, other accessories as needed by the patient may be attached. For instance, if the patient is taller, than the sidewalls 108, 112 can be extended by having the caregiver pull on the sidewalls 108, 112 at the distal end 102 of the bathing tub 100. The movable sidewall portions 109, 113 are released from being housed within the sidewalls 108, 112 and the movable sidewall portions 109, 113 define an opening 107 from the edge of the bottom wall 104 to about the distal end 102 of the bathing tub 100. The bathing tub 100 is then ready for the insert 117 to be attached, as shown in FIG. 6. The caregiver places the vertical members 118 of the insert 117 over the movable sidewall portions 109, 113 and the horizontal member 119 over the opening 107 such that the horizontal member 119 is flush with the bottom wall 104, as shown in FIG. 7. Additionally, if the patient is connected to a vitals monitor or to a respirator a caregiver may attach the medical container 192 to the horizontal support members 134 of the caster 124 through the brackets 194 on the container 192.

At this point, the caregiver may attach a hose to the drainage port 188 and lead the hose to an area from which the water from tub 100 is to be drained, for instance, a sink. The caregiver then procures water from a water source to prepare for bathing the patient. The tub 100 is then ready for use. The caregiver assists the patient in entering the interior space 122 of the tub. The patient sits on the top surface 164 of the seat 160 and the caregiver adjusts the seat 160 position by pulling the front edge 168 of the seat 160 along the slidable rail 172 such that the patient's full body can extend within the tub 100. The caregiver may then assist the patient in resting their back along the backrest portion 136. As shown in FIG. 8, the angle of the backrest 136 may then be adjusted by the caregiver by moving the bracket 137 at the proximal end 101 of the bathing tub 100 to rest on one of the plurality of support struts 141 on the back of the backrest as desired by the patient. The caregiver may then assist the patient in being strapped to the backrest 136 using the harness 140. The patient inserts each of their arms in to each of the support straps 144 of the harness and the caregiver may lock the patient in by closing the first buckle 152 and the second buckle 156. The second buckle 156 is preferably longer than the first buckle 152 since the second buckle 156 is designed to hold the patient's waist. The caregiver may then use the straps 176 on the bottom wall 104 of the bathing tub 100 to hold the patient's legs in place, if needed. The caregiver may adjust the tightness of the strap 176 by using the buckle 180 to loosen or tighten the strap 176 as needed. The caregiver would then bathe the patient as desired using the procured water source. Was the caregiver bathes the patient water exits the tub 100 through the drain 185. The water then enters the drainage basin 186 attached to the underneath surface 106 of the bottom wall 105. The water then is fed through the channel 187 until it exits the drainage port 188.

Upon competition of use the caregiver may assist the patient in exiting the interior space 122 of the tub by unstrapping the patient both from the bottom wall 104 of the bathing tub, as well as the backrest 136, as needed. Once the patient is out of the bathing tub 100, the casters 124 may be folded up such that the vertical support members 132 fold under the bottom wall 104 and the bathing tub 100 is placed in a portable or storage position, as shown in FIG. 9. The caregiver may detach the hose from the drainage port 188 and then the bathing tub 100 is ready to be rolled out of the patient's room.

Alternative embodiments are contemplated to those shown or described herein without departing from the scope of the present disclosure. For example, embodiments are contemplated in which the seat may be able to be adjusted vertically in addition to horizontally, allowing a user to sit in the tub without sitting on the bottom wall of the tub, making it easier for them to get up after completed use. Another alternative embodiment considered is making the bottom wall of the bathing tub sloped instead of flat, allowing for water to drain from the tub more quickly.

In summary, the rolling medical bedside bathing tub disclosed herein provides a caregiver with a more user-friendly method of bathing bedridden and generally immovable patients. The tub is portable and includes a drainage port, making it much easier for caregivers to transport patients to the tub. Additionally, having a seat and a backrest, along with straps and other mechanisms that aid in balancing a patient while in the tub makes the process of bathing easier and more efficient. Lastly, the tub is designed to accommodate people of varying heights and sizes, allowing for the tub to be able to be universally used for people with limited mobility.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A rolling medical bedside bathing tub comprising:

a bottom wall forming a bottom side of the bathing tub, the bottom wall having a plurality of edges;

a plurality of sidewalk, the plurality of sidewalk extending from the plurality of edges of the bottom wall defining an enclosure and including a plurality of side skirts;

an insert configured to extend the length of the bathing tub wherein the insert includes a plurality of vertical members connected to each other by a horizontal member, and further wherein the plurality of vertical members are configured to fit over at least two of the plurality of sidewalls;

a slidable seat included on the bottom wall of the bathing tub; and a plurality of casters attached to the plurality of side skirts.

2. The bathing tub of claim 1, wherein the bottom wall is comprised of a rigid, sturdy, and nonabsorbent material.

3. The bathing tub of claim 1, wherein the bottom wall includes one or more straps configured to a hold a person's legs in place.

4. The bathing tub of claim 1, wherein two of the plurality of sidewalls are movable such that they extend out of the remaining plurality of sidewalls, and further wherein the two plurality of sidewalls that are movable are parallel to each other.

5. The bathing tub of claim 1, wherein at least one of the plurality of sidewalls include a tray configured to hold a medical records and other papers.

6. The bathing tub of claim 1, wherein the slidable seat is affixed to a rail such that the position of the seat within the tub is adjustable, and further wherein the seat is slidable along the rail at a user selected, distance along the length of the bottom wall.

7. The bathing tub of claim 1, wherein the plurality of casters includes one or more vertical support members configured to attach each of the plurality of casters to the bottom side of the bottom wall of the bathing tub.

8. The bathing tub of claim 1, wherein the plurality of casters include one or more horizontal support members configured to add rigidity to the casters.

9. The bathing tub of claim 1, wherein the one or more horizontal support members includes a container configured to hold medical equipment.

10. The bathing tub of claim 1, wherein the bottom wall includes a drain.

11. The bathing tub of claim 10, wherein the drain is connected to a drainage basin, and further wherein the drainage basin includes a drain port.

12. The bathing tub of claim 11, wherein the drain port is sized and configured to attach a tubing and to release a water from the bathing tub.

13. The bathing tub of claim 1, wherein the bathing tub further includes a backrest.

14. The bathing tub of claim 13, wherein the backrest includes a harness.

15. The bathing tub of claim 13, wherein the backrest includes a plurality of support struts adapted to releasably position the backrest in at least one inclined position above a horizontal level.

16. The bathing tub of claim 15, wherein at least one of the plurality of sidewalls includes a bracket configured to mate with the plurality of support struts of the backrest to enable the backrest to maintain at least one inclined position above a horizontal level.

17. A rolling medical bedside bathing tub comprising:

a bottom wall forming a bottom side of the bathing tub; the bottom wall having a plurality of edges;

a plurality of sidewalls, the plurality of sidewalls extending from the plurality of edges of the bottom wall defining an enclosure and including a plurality of side skirts, wherein at least two of the plurality of sidewalls are both movable and extendable out of the remaining plurality of sidewalls; and further wherein the at least two plurality of sidewalls that are movable are parallel to each other;

an insert configured to extend the length of the bathing tub, wherein the insert includes a plurality of vertical members connected to each other by a horizontal member; and further wherein the plurality of vertical members are configured to fit over at least two of the plurality of sidewalls;

a slidable seat included on the bottom wall of the bathing tub;

a drain included on the bottom wall of the bathing tub, the drain being connected to a drainage basin configured to release a water from the bathing tub; and a plurality of casters attached to the plurality of side skirts.

18. A rolling medical bedside bathing tub comprising:

a bottom wall forming a bottom side of the bathing tub; the bottom wall having a plurality of edges;

a plurality of sidewalls, the plurality of sidewalls extending from the plurality of edges of the bottom wall defining an enclosure and including a plurality of side skirts, wherein at least two of the plurality of sidewalls are both movable and extendable out of the remaining plurality of sidewalk, and further wherein the at least two plurality of sidewalls that are movable are parallel to each other;

an insert configured to extend the length of the bathing tub, wherein the insert includes a plurality of vertical members connected to each other by a horizontal member, and further wherein the plurality of vertical members are configured to fit over at least two of the plurality of sidewalls;

a slidable seat included on the bottom wall of the bathing tub;

a backrest having a harness and affixed to a portion of the bottom wall, wherein the backrest includes a plurality of support struts adapted to releasably position the backrest in at least one inclined position above a horizontal level, and further wherein at least one of the plurality of sidewalls includes a bracket configured to mate with the plurality of support struts of the backrest to enable the backrest to maintain at least one inclined position above a horizontal level;

a drain included on the bottom wall of the bathing tub, the drain being connected to a drainage basin configured to release a water from the bathing tub; and a plurality of casters attached to the plurality of side skirts.

* * * * *